United States Patent [19]

O'Meara

[11] 4,297,037

[45] Oct. 27, 1981

[54] VACUUM ATTACHED VIBRATOR APPARATUS

[75] Inventor: David M. O'Meara, Joliet, Ill.

[73] Assignee: Chicago Bridge & Iron Company, Oak Brook, Ill.

[21] Appl. No.: 147,857

[22] Filed: May 8, 1980

[51] Int. Cl.[3] ..... B01F 11/00

[52] U.S. Cl. ..... 366/114

[58] Field of Search ..... 366/114, 115, 600, 108; 74/26, 61

[56] References Cited

U.S. PATENT DOCUMENTS

| | | | |
|---|---|---|---|
| 3,106,652 | 10/1963 | Burt | 366/114 X |
| 3,363,806 | 1/1968 | Blakeslee | 366/114 X |
| 3,633,878 | 1/1972 | Mendius | 366/114 |
| 3,731,907 | 5/1973 | Lash | 366/114 |

*Primary Examiner*—Edward J. McCarthy

*Attorney, Agent, or Firm*—Merriam, Marshall & Bicknell

[57] ABSTRACT

Apparatus for removable attachment to a rigid surface for vibrating the same comprising a vacuum plate having a face with an elastomeric gasket around the face periphery and contactable with said rigid surface; a vibrator mount on the vacuum plate; a vibrator joined to the vibrator mount; and said elastomeric gasket projecting sufficiently forward from the vibrator mount and the vacuum plate to prevent the vibrator mount and the vacuum plate from touching the rigid surface when attached thereto so that all vibrations developed by the vibrator are transmitted to the rigid surface through the elastomeric gasket and the pressure waves in the vacuum plate.

7 Claims, 6 Drawing Figures

VACUUM ATTACHED VIBRATOR APPARATUS

This invention relates to vibrator apparatus used to compact or settle granular and viscous liquid materials. More particularly, this invention is concerned with vibrator apparatus for compacting granular insulating material in the walls of insulated tanks and vessels.

BACKGROUND OF THE INVENTION

The storage of materials in tanks or vessels at temperatures above or below ambient temperature requires the use of insulation. Often the tanks or vessels are double walled with insulation filling the space between the inner and outer walls. The insulation used is often granular, such as perlite, but to avoid creating voids when the cavity or space between the walls is filled with insulation it is common to vibrate the outer wall. Vibrating the wall also helps to compact the insulation so that less settling occurs later.

Mendius U.S. Pat. No. 3,633,878 discloses vibrating apparatus for settling insulation in an insulated tank. The vibrator apparatus disclosed in the Mendius patent is removably attached to a tank wall by permanent magnets, electromagnets or vacuum means. Each embodiment has the impact plate pressed into engagement with the tank wall in vibration transmitting relationship. This causes damage to a painted surface being vibrated and also results in the apparatus walking or moving along the surface as vibrating proceeds thereby widening the damaged painted area and directing the vibrating away from the desired area. Furthermore, it is difficult to land a vacuum attachable apparatus, as shown in FIG. 5 of the Mendius patent, on a tank wall high above ground with enough contact to readily produce a vacuum.

SUMMARY OF THE INVENTION

According to the present invention, it has been found that a vibrator can be removably attached readily by vacuum to a surface and that it is unnecessary to have actual contact between a vibrator impact plate and the surface to be vibrated.

The invention provides apparatus for removable attachment to a rigid surface for vibrating the same comprising a vacuum plate having a face with an elastomeric gasket around the face periphery and contactable with said rigid surface, a vibrator mount on the vacuum plate, a vibrator joined to the vibrator mount, and said elastomeric gasket projecting sufficiently forward from the vibrator mount and the vacuum plate to prevent the vibrator mount and the vacuum plate from touching the rigid surface when attached thereto so that all vibrations developed by the vibrator are transmitted to the rigid surface through the elastomeric gasket and the pressure waves in the vacuum plate.

The vacuum plate can have a means for attaching a vacuum line to it to draw a vacuum behind the vacuum plate to hold it in place on the rigid surface. This approach, however, requires running a vacuum line, and an air pressure line when an air driven vibrator is used, usually from the ground to the apparatus high above ground. An electric driven vibrator would require an electric line instead of an air pressure line. Either way two lines would be needed. Therefore, it is advantageous to mount an air operated eductor on the vacuum plate so that it communicates with a port in the vacuum plate. An air pressure branch line can then be run from an air driven vibrator to the eductor to create the vacuum. In this way, only one line is needed to drive the vibrator and develop the vacuum.

The apparatus also desirably includes magnet means mounted on a bracket extending outwardly from and joined to the vacuum plate and positioned so that the rigid surface can be contacted by both the magnet means and the vacuum plate together. The bracket is advantageously pivotally joined to the vacuum plate to accommodate compression of an elastomeric seal or gasket around the vacuum box periphery.

DETAILED DESCRIPTION OF THE DRAWINGS

So far as it is practical and increases clarity the same numbers will be used to identify the same or similar elements in the various views of the drawings.

Figure 1:
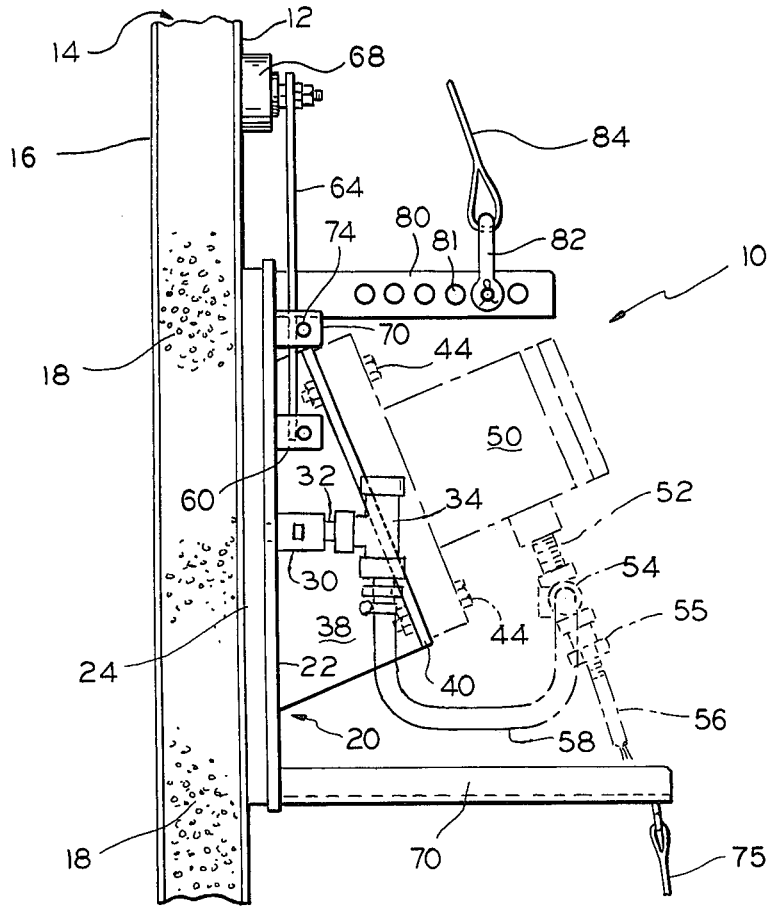
FIG. 1 is a side elevational view of apparatus according to the invention on a tank wall.
Figure 2:
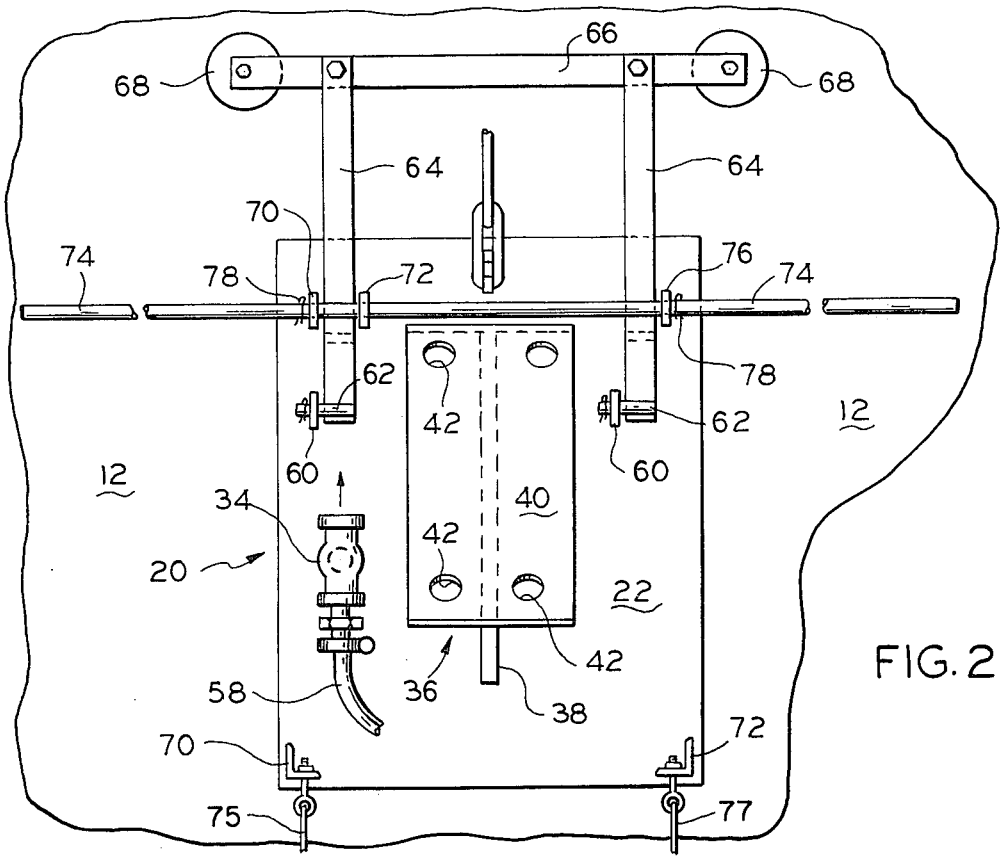
FIG. 2 is a front elevational view of the apparatus shown in FIG. 1.
Figure 3:
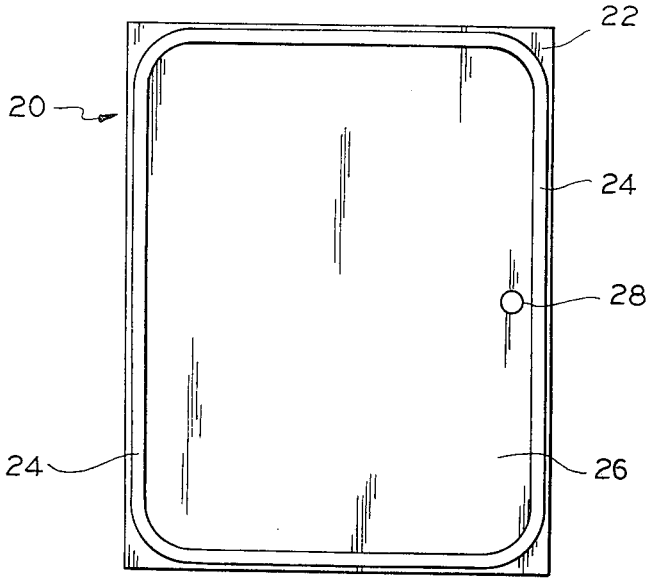
FIG. 3 is a rear elevational view of the vacuum plate.
Figure 4:
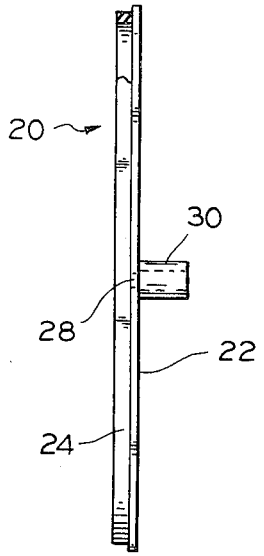
FIG. 4 is a side elevational view of the vacuum plate shown in FIG. 3.
Figure 5:
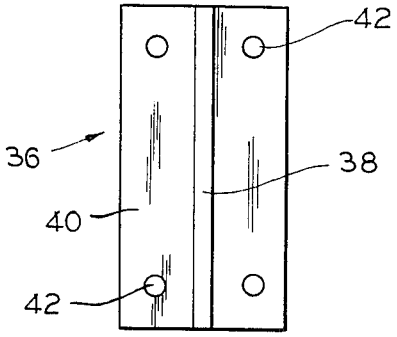
FIG. 5 is a rear elevational view of the vibrator mounting plate.
Figure 6:
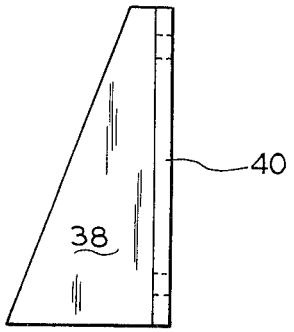
FIG. 6 is a side elevational view of the vibrator mounting plate shown in FIG. 5.

With reference to FIGS. 1 and 2, the apparatus 10 provided by the invention is attached to the outer wall 12 of double-walled tank 14. The space between tank inner wall 16 and tank outer wall 12 is filled with insulation 18, such as perlite, to be compacted by vibration of the tank outer wall 12.

The apparatus 10 includes a vacuum plate 20 (FIGS. 1 to 4) comprising a metal plate 22 and an elastomeric gasket 24 bonded to the peripheral edge of the rear face 26 of the metal plate 22. A hole or port 28 is provided in plate 22 so that air can be removed from behind the vacuum plate 20 and a vacuum created when it contacts a surface, such as the outer surface of tank wall 12. Coupling 30 is welded to plate 22 around hole 28 so as to receive a pipe nipple 32, to which eductor 34 is threadedly connected.

Vibrator mount 36 (FIGS. 1, 2, 5 and 6) consists of a triangular plate 38 to which rectangular plate 40 is welded laterally. Holes 42 are provided in plate 40 so as to removably connect air vibrator 50 to the plate by bolts 44.

Air vibrator 50 (Navco-BH3 Short or an equivalent model) is provided with a fitting 52 to which a tee-fitting 54 is attached. An air hose quick connect coupling 55 is joined to the outer end of tee 54 for connecting air hose 56 which supplies air under pressure to drive vibrator 50. Air line 58 extends from tee 54 to the inlet of eductor 34. As pressurized air flows through the eductor it draws air with it from behind the vacuum plate 20 and thereby develops a vacuum.

Two spaced-apart stub bars 60 are laterally joined to the front face of plate 22. Each bar 60 has a hole in which a rod 62 is pivotally positioned. Each rod 62 is welded to the lower end of a vertical bar 64. The top end of each bar 64 is bolted to horizontal bar 66 which extends outwardly beyond the width of metal plate 22. A permanent magnet 68 is bolted to each end of bar 66.

Bars 70 and 72 are laterally joined to metal plate 22 on each side of one of the bars 64 to prevent the bar 64 from moving sidewardly. Each of the bars 70 and 72 has a hole in which round rod 74 is positioned. A bar 76 is laterally joined to metal plate 22 adjacent the other bar 64. Bar 76 also has a hole for receiving rod 74. Pins 78 through rod 74 keep it from sliding out of bars 70, 72, 76. The rod 74 is positioned in front of bars 64 so that the pivoting of bars 64 is limited to the distance between rod 74 and metal plate 22. As a result, the magnets 68 are maintained so as to have their contacting faces close to alignment with the plane of the gasket contacting face. By having the bars 64 pivotally mounted in bars 60, the magnets can remain stationary even though the vacuum box moves forward as the vacuum develops and the gasket is compressed. This is possible because the magnet support bracket composed of bars 64 and 66 does not hinder such relative motion.

A pair of angle bars 70 and 72 are laterally joined at one end to the bottom corner areas of metal plate 22. A hole at the outer end of each angle bar 70 and 72 provides a means by which guide lines 75 and 77 are attached.

A bar 80 is laterally joined to the upper center of metal plate 22. Bar 80 has a series of holes 81 by which clevis 82 can be connected to it. Support cable 84 extends from the clevis 82 to the roof (not shown) of tank 14.

The described apparatus is put into use by first suspending it from some suitable support so as to place it close to a surface or wall to be vibrated. If a storage tank wall is to be vibrated, the apparatus can be suspended from the tank roof by cable 84. The elongated horizontal rod 74 is made long enough so as to prevent spinning or rotation of the apparatus about a vertical axis, even on windy days, when it is moved from one position to another along a tank wall or other vertical surface. Guide lines 75 and 77 can extend to the ground so that a ground based operator can move the apparatus from one location to another location on the tank wall.

When the apparatus is moved to a location where it is to be operated, the magnets 68 serve to pull the apparatus toward the metal surface to be vibrated and place the gasket 24 in contact with the surface. Pulling on lines 75 and 77 also helps to press the gasket tightly against the surface to be vibrated. Air under pressure is then supplied by air hose 58 simultaneously to vibrator 50 and eductor 34. The vibrator is thus operating as the vacuum is produced. The vacuum is developed in a very short period because of the small volume behind the vacuum plate 20. The apparatus is held firmly in place during the vibrating and does not slide around on the surface, such as a tank surface. There is no metal-to-metal contact between the vibrator 50 and the surface being vibrated so that the surface, often a painted surface, is not abraded. Nevertheless, the vibrations produced by the vibrator are effectively transmitted to the surface being vibrated and compaction or settling of insulation is quickly achieved.

After an area of a surface has been adequately vibrated, the air pressure is turned off so as to stop vibrator 50. A ground located valve can be used for this purpose. Since only one air supply hose need be used, when it is turned off the eductor is simultaneously inactivated with the vibrator and the vacuum behind vacuum plate 20 is lost. Lines 75 and 77 can then be pulled outwardly from the vertical surface to take the gasket 24 out of contact with the surface. The magnets 68 are easily removed from contact with the vertical surface in this way because the bars 64 act as pry bars. With the apparatus out of contact with the vertical surface, but still suspended by cable 84, it can be moved to a different surface area and then placed in operation again.

The relative simplicity of the described apparatus avoids high apparatus investment. Furthermore, the apparatus is adaptable to use on large and small diameter tank walls since it is only necessary to roll metal plate 22 to a suitable size rather than to build a vacuum box. However, the size and spacing of the magnets should be adjusted so as to make good contact with the tank wall.

Although the apparatus illustrated in the drawings uses permanent magnets, it is also possible to use electromagnets instead. However, there is generally no advantage in using electromagnets and they have the disadvantage of requiring electrical supply lines.

The foregoing detailed description has been given for clearness of understanding only, and no unnecessary limitations should be understood therefrom, as modifications will be obvious to those skilled in the art.

What is claimed is:

1. Apparatus for removable attachment to a rigid surface for vibrating the same comprising:

a vacuum plate having a face with an elastomeric gasket around the face periphery and contactable with said rigid surface;

a vibrator mount on the vacuum plate;

a vibrator joined to the vibrator mount; and said elastomeric gasket projecting sufficiently forward from the vibrator mount and the vacuum plate to prevent the vibrator mount and the vacuum plate from touching the rigid surface when attached thereto so that all vibrations developed by the vibrator are transmitted to the rigid surface through the elastomeric gasket and the pressure waves in the vacuum plate.

2. Apparatus according to claim 1 in which the vacuum plate has a port for removing air from the vacuum plate, and an eductor communicates with the port for producing a vacuum behind the vacuum plate.

3. Apparatus according to claim 2 in which the vibrator is air powered and has an air supply fitting for supplying pressurized air to the vibrator, and an air conduit extends from the air supply fitting to the eductor.

4. Apparatus according to claim 1 in which magnet means mounted on a bracket extends outwardly from and is joined to the vacuum plate and is positioned so that the rigid surface can be contacted by both the magnet means and the vacuum plate together.

5. Apparatus according to claim 4 in which the bracket is pivotally joined to the vacuum plate.

6. Apparatus according to claim 1 including bars joined to the vacuum plate for attaching guide lines to position the apparatus.

7. Apparatus according to claim 6 including an elongated rod horizontally mounted on the vacuum plate to prevent it from spinning about a vertical axis.

* * * * *